US010451364B2

(12) United States Patent
Riondet et al.

(10) Patent No.: US 10,451,364 B2
(45) Date of Patent: Oct. 22, 2019

(54) COLLECTOR BOX FOR A HEAT EXCHANGER, IN PARTICULAR FOR A MOTOR VEHICLE, COVER FOR SAID BOX, AND HEAT EXCHANGER INCLUDING SUCH A BOX

(71) Applicant: Valeo Systemes Thermiques, Le Mesnil Saint Denis (FR)

(72) Inventors: Christian Riondet, Bourgogne (FR); Jean-Marc Lesueur, Boult sur Suippe (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 161 days.

(21) Appl. No.: 14/366,097

(22) PCT Filed: Dec. 18, 2012

(86) PCT No.: PCT/EP2012/075987
§ 371 (c)(1),
(2) Date: Jun. 17, 2014

(87) PCT Pub. No.: WO2013/092610
PCT Pub. Date: Jun. 27, 2013

(65) Prior Publication Data

US 2014/0332190 A1 Nov. 13, 2014

(30) Foreign Application Priority Data

Dec. 19, 2011 (FR) ..... 11 61891

(51) Int. Cl.
*F28F 9/02* (2006.01)
*F28D 1/053* (2006.01)

(52) U.S. Cl.
CPC ..... *F28F 9/02* (2013.01); *F28F 9/0226* (2013.01); *F28D 1/05316* (2013.01); *F28F 9/0224* (2013.01); *F28F 2225/08* (2013.01)

(58) Field of Classification Search
CPC .... F28F 9/0224; F28F 9/0226; F28F 2225/08; F28F 2275/122; F28F 2275/14
(Continued)

(56) References Cited

U.S. PATENT DOCUMENTS 7,341,098 B2 * 3/2008 Brost ..... F28D 1/05366 165/149
2011/0017434 A1 1/2011 Lesueur et al.
(Continued)

FOREIGN PATENT DOCUMENTS

DE 102009049483 A1 4/2011
FR 2927411 A1 8/2009
FR 2938052 A1 5/2010

OTHER PUBLICATIONS

Lesueur et al. (WIPO Pub. No. WO 2009/101101), published on Aug. 20, 2009.*
(Continued)

*Primary Examiner* — Paul Alvare
(74) *Attorney, Agent, or Firm* — Howard & Howard Attorneys PLLC

(57) ABSTRACT

The invention relates to a collector box for a heat exchanger, in particular for a motor vehicle, including a collector plate (5), a cover (6), and a seal (7) for providing a seal between said collector plate (5) and said cover (6), said seal (7) including an attachment portion (22) configured so as to engage with at least one tube for circulating fluid of the heat exchanger, said attachment portion (22) having a projection (24) for grasping said seal, said cover having at least one recess (30) for accommodating said grasping projection
(Continued)

(24). The invention also relates to a cover for said collector box and to a heat exchanger including such a collector box.

9 Claims, 4 Drawing Sheets

(58) Field of Classification Search
USPC ..... 165/149, 153, 173, 906
See application file for complete search history.

(56) References Cited

U.S. PATENT DOCUMENTS

| | | | |
|---|---|---|---|
| 2011/0088886 | A1 | 4/2011 | Kalbacher et al. |
| 2012/0097379 | A1 | 4/2012 | Riondet et al. |

OTHER PUBLICATIONS

English language abstract for DE102009049483 extracted from espacenet.com database on Jul. 29, 2014, 4 pages. Also see English equivalent US 2011/0088886.
English language abstract for FR2927411 extracted from espacenet.com database on Jul. 29, 2014, 2 pages. Also see English equivalent US 2011/0017434.
English language abstract for FR2938052 extracted from espacenet.com database on Jul. 29, 2014, 2 pages. Also see English equivalent US 2012/0097379.
International Search Report for PCT/EP2012/075987 dated May 28, 2013, 5 pages.

* cited by examiner

COLLECTOR BOX FOR A HEAT EXCHANGER, IN PARTICULAR FOR A MOTOR VEHICLE, COVER FOR SAID BOX, AND HEAT EXCHANGER INCLUDING SUCH A BOX

RELATED APPLICATIONS

This application is the National Stage of International Patent Application No. PCT/EP2012/075987, filed on Dec. 18, 2012, which claims priority to and all the advantages of French Patent Application No. FR 11/61891, filed on Dec. 19, 2011, the content of which is incorporated herein by reference.

The invention relates to a collector box for a heat exchanger, in particular for a motor vehicle. It also relates to a cover for said box as well as a heat exchanger including such a box. This may in particular involve radiators in which a heat-exchanging liquid circulates which serves for cooling of the engine of the vehicle and which is intended to be situated on the front face of said vehicle.

Heat exchangers are known which comprise a bundle of parallel tubes and two collector boxes in which the corresponding ends of the tubes are connected in a fixed and sealed manner. Thus a fluid can circulate through the tubes and exchange heat with an external air stream passing between the tubes.

Collector boxes are known which comprise a metal collector plate and a plastic cover, crimped on the plate. In order to ensure sealing between the cover and the box, an elastomer seal is used.

Traditionally, the collector boxes are equipped with a groove within which the seal is positioned so that it may be compressed between the cover and the collector plate during the crimping.

Boxes have likewise been proposed in which the plate collectors, referred to as flat, do not have a groove. The seal is then supported on the face of the collector plate in the region of which the passage openings of the tubes for circulating fluid emerge, at least in the region of the longitudinal ends of the boxes. Such boxes are principally useful in reducing the space required as well as the weight, in particular the operating weight, of the exchanger. In fact, in the absence of a groove for the seal, the dimensions of the collector plate are reduced. The same applies to the internal volume of the box and the quantity of fluid to be circulated in the exchanger can thus be limited.

However, such collector boxes necessitate finding alternative solutions to the groove for positioning the seal. Good positioning of the latter is in fact necessary in order to ensure the reliability of the seal between the cover and the collector plate.

In this respect seals have already been proposed, referred to as extended seals, comprising a cord, making it possible to ensure the sealing function of the seal, and an attachment portion supported on the ends of the tubes, referred to below as exterior tubes, situated on both sides of the bundle. Said attachment portion makes it possible in this way to install the seal in extension on the collector plate, which ensures the correct positioning of the cord during crimping. In order to facilitate positioning, such seals have tabs enabling them to be placed in extension on said exterior tubes.

However, the applicant has discovered a difficulty. In the current configuration of the boxes, said tabs are compressed against the emerging ends of said exterior tubes by the cover. This results in a deformation of said exterior tubes, which risks causing various failures when the exchanger is used.

The first solution would be to increase the size of the boxes but this would defeat the object of the exchangers with flat collector plates.

The object of the invention is to improve the situation and to this end discloses a heat exchanger collector box, in particular for a motor vehicle, comprising a collector plate, a cover and a seal which ensures sealing between said collector plate and said cover, said seal comprising an attachment portion configured in order to be supported on at least one tube for circulating fluid of the exchanger, said attachment portion having a projection for grasping said seal, said cover having at least one recess which receives said grasping projection.

Such an arrangement makes it possible to use seals of the extended type whilst avoiding compression of the grasping projection of said seals between the tube and the cover of the collector box. In this way the risk of deformation of the exterior tubes of the exchanger is decreased whilst enabling the use of exchangers with flat collector plates.

According to different embodiments of the invention, which may be taken together or separately:

- said recess or recesses are situated by one end or both ends of said cover,
- said collector plate is crimped to said cover on both sides of said recess,
- said collector plate comprises two crimping teeth supported on a shoulder of the cover located on both sides of said recess,
- said crimping teeth supported on the shoulder of the cover situated on both sides of said recess are located on a first side of the collector plate, said collector plate comprises crimping teeth on sides adjacent to said first side and the crimping teeth located on both sides of the recess have a width greater than that of the teeth located on said adjacent sides,
- said cover comprises a arch prolonged by a box foot, said box foot serving to compress the seal, a back wall of said recess being situated perpendicular to said box foot,
- said back wall is in the continuation of said box foot,
- said compartment is defined by a localised deformation of a profile of the arch of said cover.

The invention also relates to a collector box cover as described above. The invention also relates to a heat exchanger, in particular for a motor vehicle, comprising such a collector box.

The appended figures will provide a good understanding of how the invention can be carried out. On these drawings, identical references designate similar elements.

Figure 1:
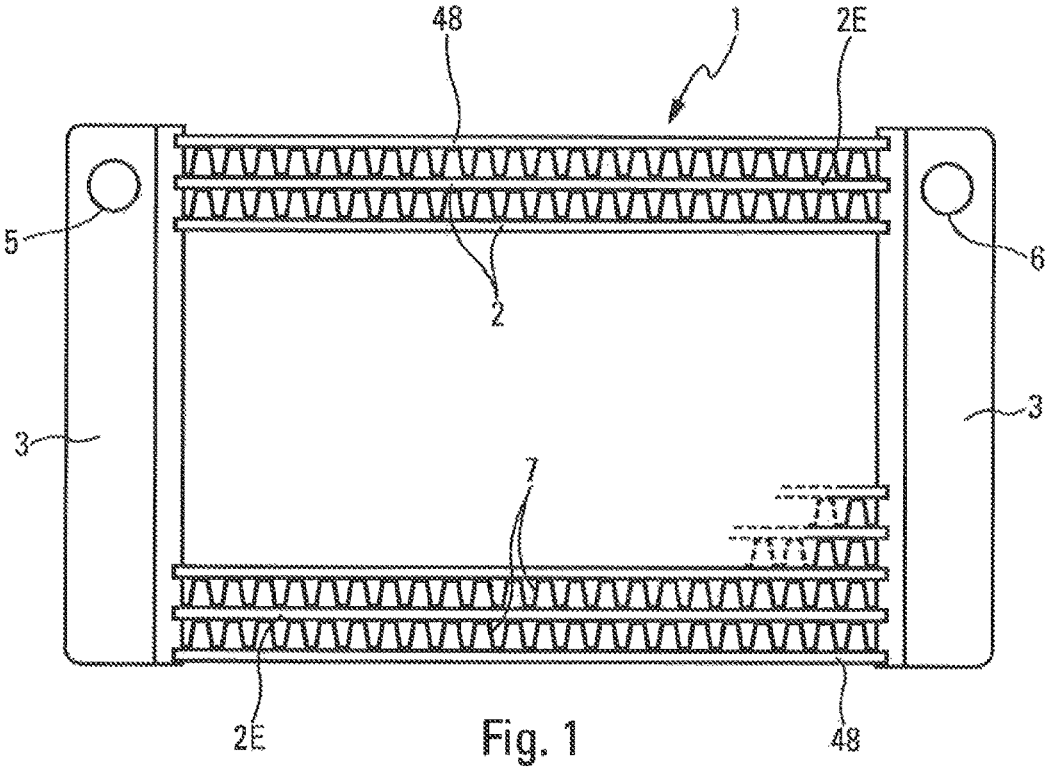
FIG. 1 shows an overall schematic view of a heat exchanger for which collector boxes according to the present invention are intended.

As illustrated in FIG. 1, the invention has applications in a heat exchanger comprising tubes 2 which in this case form a bundle in which said tubes 2 are parallel to one another. Each tube 2 has two longitudinal ends connected in a fixed and sealed manner to collector boxes 3 of the exchanger for the circulation of a fluid, in particular cooling liquid or the like. Said exchanger may comprise side walls 48 which make it possible to protect the bundle laterally. Amongst said tubes 2 are the tubes $\mathbf{2}_E$, so-called exterior tubes, located on both sides of said bundle.

Spacers 17 could be arranged between the tubes 2, 2E and increase the heat exchange surface between the fluid circulating in said tubes 2, 2E and a fluid, in particular air, passing through the exchanger. Such spacers 17 could also be used between the exterior tubes $\mathbf{2}_E$ and the side walls 48.

In this case inlet and outlet flanges or pipes 5, 6 respectively for the fluid are respectively attached to the collector boxes 3.

This being the case, the invention relates more particularly to the collector boxes 3 of said exchanger.

Figure 2:
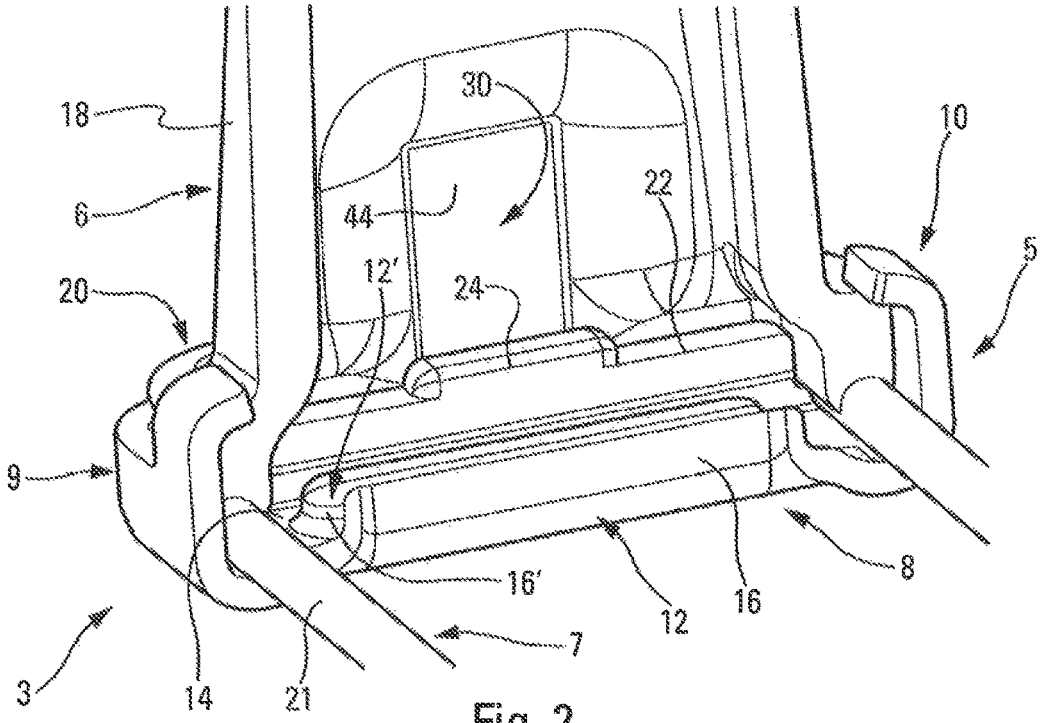
FIG. 2 shows partially, in perspective, one of the collector boxes of the exchanger of FIG. 1, said box being shown from within, the cover and the collector plate being cut transversely.
Figure 4:
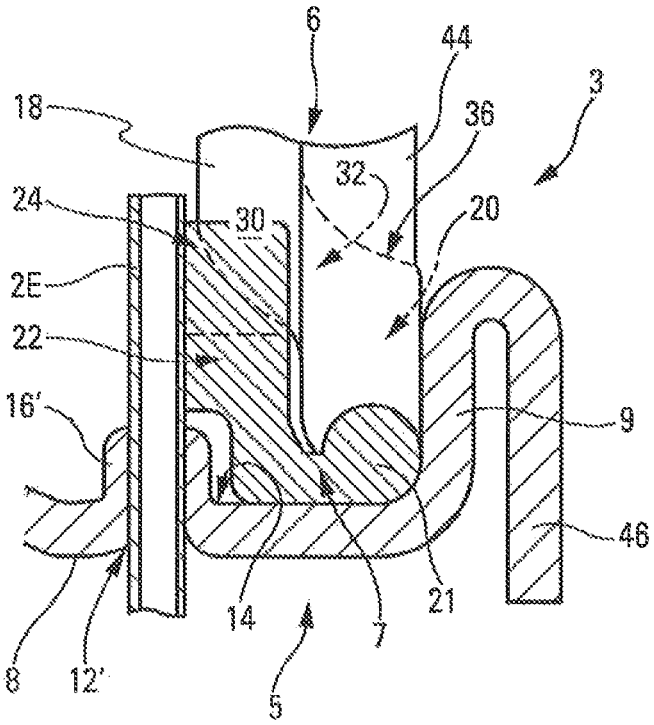
FIG. 4 shows a longitudinal sectional view of the portion of collector box shown in FIG. 2.

As illustrated on FIGS. 2 and 4, said collector box or boxes 3 according to the invention comprise a collector plate 5, a cover 6 and a seal 7, which ensure sealing between said collector plate 5 and said cover 6. In this case, said box 3 has an elongated shape, in particular a substantially parallele pipedal shape. The collector plate 5 is, for example, made of metal, in particular in aluminium or aluminium alloy. The cover 6 is, for example, made of plastic. It is crimped on the collector plate 5.

Said collector plate 5 comprises for example a centrepiece 8 and an edge 9 turned up from the periphery of said centrepiece 8. Said turned-up edge 9 has crimping teeth 10. In this case said collector plate 5 has openings 12, 12' through which the ends of the tubes, not shown on FIG. 2, emerge into an internal space defined by said boxes 3. Said passage openings 12, 12' of the tubes are, for example, in a central part of the centrepiece 8, surrounded by a peripheral portion which houses said seal 7. In this case said centrepiece 8 is substantially rectangular.

Said collector plate 5 is advantageously of the flat plate type. In other words, said collector plate 5 has no groove or only partially has a groove to accommodate the seal 7. Thus said collector plate 5 is configured so that the seal 7 is supported on a face 14 of the centrepiece 8, face 14 where the passage openings of the tubes for circulating fluid emerge inside the collector box 3, at least in the region of the longitudinal end or ends of said collector box 3. As illustrated, said collector plate 5 may also comprise collars 16, 16' for passage of tubes, projecting inwards from said flat face 14, without calling into question the type of collector plate used.

In other words, said collector plate 5 is configured in order to accommodate the seal 7 perpendicular to the peripheral portion of the centrepiece 8 in the region of said flat face 14, at least in the region of the longitudinal ends of boxes. Again, in other words, the seal 7 is accommodated in the region of said flat face 14 on all the contour of said seal 7 or at least in the region of the portion of the contour thereof located between the opening 12' and/or the collar 16' for passage of the exterior tubes and the portion of the turned-up edge 9, situated facing one another.

Said cover 6 comprises, for example, an arch 18 prolonged by a box foot 20, intended to come into alignment with the peripheral portion of said peripheral portion of the centrepiece 8 of the collector plate 5.

Figure 3:
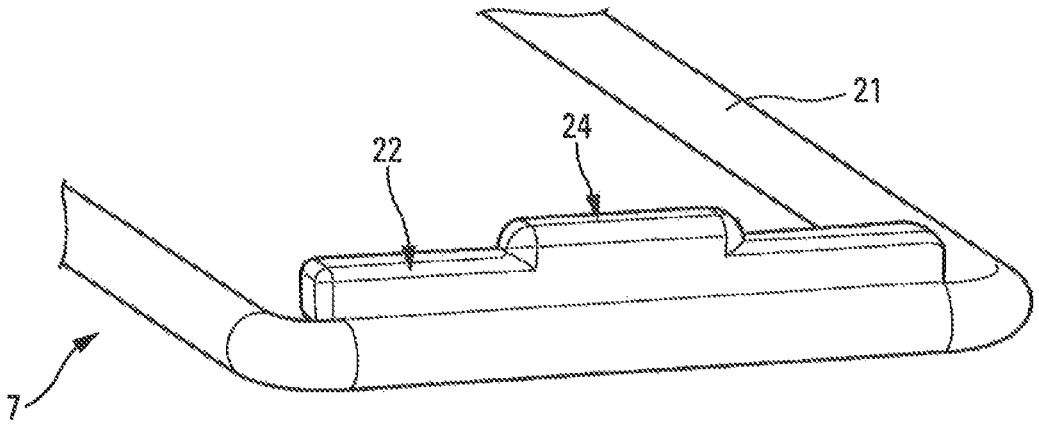
FIG. 3 shows partially, in perspective, the sealing joint of FIG. 2 considered alone.

As can be seen more particularly on FIG. 3, said seal 7 comprises a cord 21. Said cord 21 forms a closed contour, corresponding to the profile of the peripheral portion of the centrepiece 8 of the collector plate 5, namely in this case a substantially rectangular profile. Said cord 21 has, for example, a circular cross-section.

Said seal 7 also comprises at least one attachment portion 22, configured in order to be supported on a tube for circulating fluid of the exchanger. In this case said attachment portion 22 is located at one and/or the other of the ends of the seal 7. In this way it co-operates with the associated exterior tube 2E. Said attachment portion 22 is, for example, in the form of a bar of material coming from the cord 21, along one small side or the small sides of said cord 21. Said attachment portion 22 has a grasping projection 24 of said seal 7. This may be, for example, a tab extending from said bar of material.

Referring once again to FIGS. 2 and 4, it will be noted that said cord 21 ensures sealing between said collector plate 5 and said cover 6, in this case by being compressed between the box foot 20 and the peripheral portion of the centrepiece 8 of the collector plate 5, during the crimping of the cover 6 on said collector plate 5.

Said attachment portion 22 serves to hold the seal 8 in position, ensuring that it extends between the exterior tubes 2E.

According to the invention, said cover 6 has at least one recess 30 which houses said grasping projection 24. Said recess 30 is in particular configured in order to create a space between the exterior tubes 2E and the cover 6, in the region of said grasping projection 24, this space enabling said grasping projection 24 to be kept spaced apart from said cover 6 or, at the very least, to be only in flush contact, that is to say in contact with said cover 6 without being deformed by this latter. On FIG. 4 it will be noted that the recess 30 makes it possible for the rest of the cover 6, in particular the portion 32 of the arch 18, not to be in contact with said grasping portion 24. In this way the compression of said grasping projection 24 between the exterior tubes 2E and the arch 18 of said cover 6 is avoided.

Figure 5:
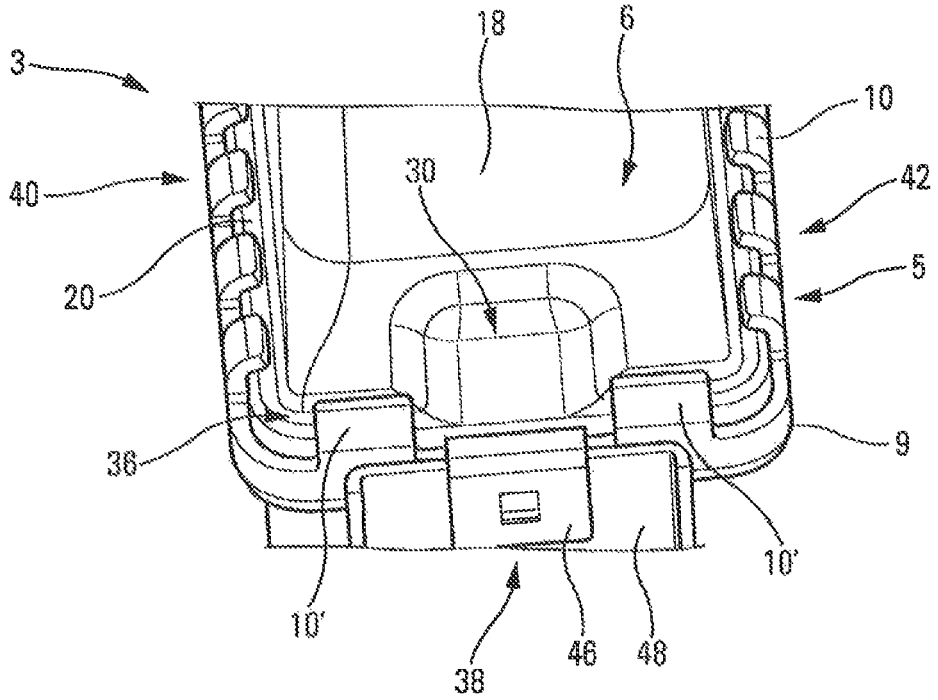
FIG. 5 shows partially, in perspective, said box, seen from the outside, mounted on the exchanger.

As shown on FIG. 5, said collector plate 5 can be crimped to said cover 6 on both sides of said recess 30. For this purpose the collector plate 5 comprises for example two crimping teeth 10' supported on a shoulder 36 of the cover 6 situated on both sides of said recess 30. Said shoulder 36 can extend round the rest of said cover 6 in order to co-operate with the other crimping teeth 10.

The crimping teeth 10' supported on the shoulder 36 of the cover 6 situated on both sides of said recess 30 are located in this case in the region of a first side 38 of the collector plate 5, namely in the region of one of the longitudinal ends thereof, and said collector plate 5 comprises said other crimping teeth 10 on sides 40, 42 adjacent to said first side 38, The crimping teeth 10' located on both sides of the recess 30 may have a width greater than that of the teeth 10 located on said adjacent sides 40, 42.

In this case said collector plate 5 comprises a tab 46 for attachment of one of said side walls 48 of the exchanger. Said tab 46 extends from the turned-up edge 9. It is situated between said crimping teeth 10' located on both sides of said recess 30. Said tab 46 and said compartment 30 are thus located to the same level, on both sides of said turned-up edge 9.

Figure 6:
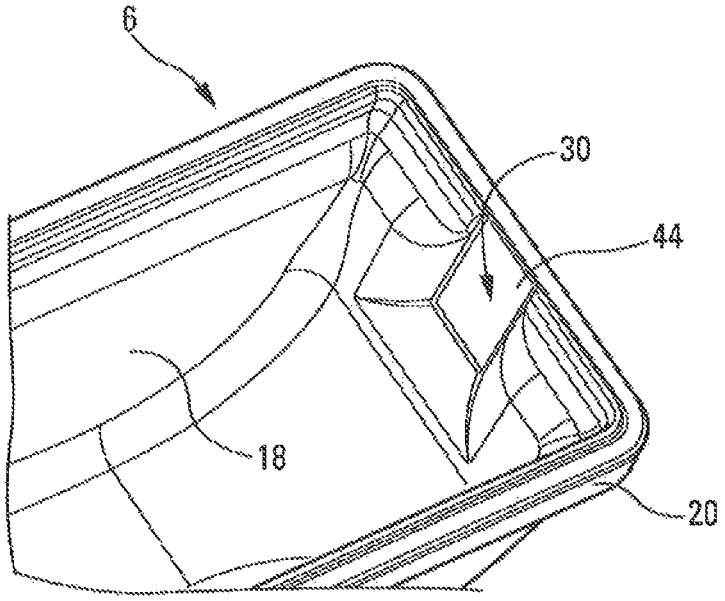
FIG. 6 shows partially, in perspective, the cover of said box, seen from within.
Figure 7:
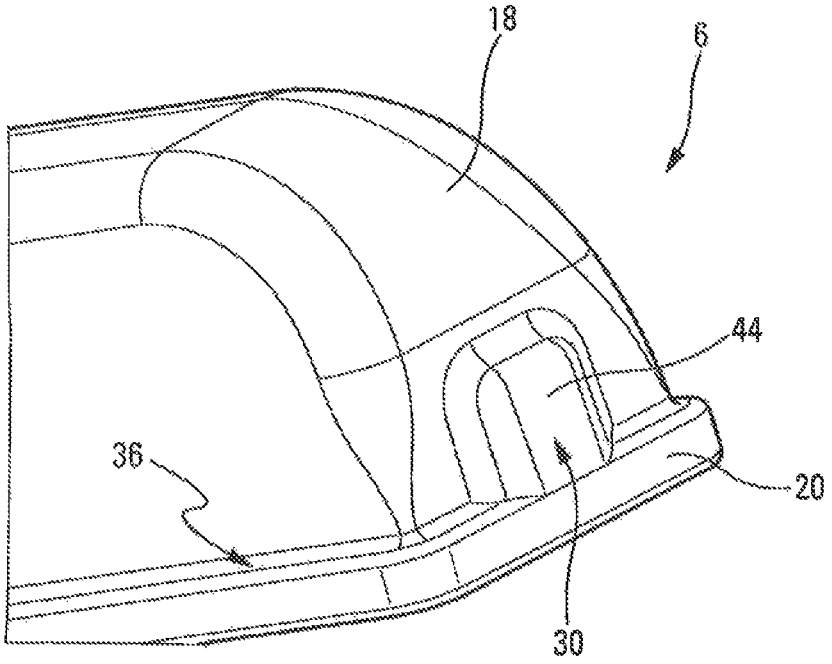
FIG. 7 shows partially, in perspective, the cover, seen from the outside.

As illustrated on FIGS. 6 and 7, a back wall 44 of said recess is situated, for example, perpendicular to said box foot 20. Said back wall 44 is, for example, in the continuation of said box foot 20. In other words, the internal and external faces of said back wall 44 of the recess 30 are respectively in the continuation of the internal and external faces of the box foot 20. Thus said back wall 44 of the recess 30 has the same thickness as that of the box foot 20.

In this case said recess 30 is defined by a localised deformation of a profile of the arch 18 of said cover 6. It is situated on both sides of a median plane of said cover 6. On the rest of the periphery of the cover 6 and in particular on both sides of said recess 30, the arch 18 is connected to said box foot 20 by means of said shoulder 36.

The invention claimed is:

1. A collector box of a heat exchanger for a motor vehicle, said collector box comprising a collector plate (5), a cover (6) and a seal (7) which ensures sealing between said collector plate (5) and said cover (6), said seal (7) comprising an attachment portion (22) configured to be supported on at least one tube (2E) that circulates fluid of the heat exchanger, said attachment portion (22) having a grasping projection (24) for grasping said seal (7), said cover (6) having at least one recess (30) which receives said grasping projection (24), wherein said cover (6) comprises an arch (18) prolonged by a box foot (20), said box foot (20) serving to compress said seal (7), with a back wall (44) of said at least one recess (30) being situated perpendicular to said box foot (20) and wherein said at least one recess (30) is located on a portion (32) of the arch (18) and protrudes along the portion (32) in a direction away from said grasping projection (24) when assembled and wherein said at least one recess (30) creates a space between the at least one tube (2E) and the cover (6) in a region of said grasping projection (24).

2. A collector box according to claim 1, having an elongated shape and in which said at least one recess (30) is situated in a region of one end or ends of said cover (6).

3. A collector box according to claim 1, wherein said collector plate (5) is crimped to said cover (6) on both sides of said at least one recess (30).

4. A collector box according to claim 3, wherein said collector plate (5) comprises two crimping teeth (10') supported on a shoulder (36) of said cover (6) situated on both sides of said at least one recess (30).

5. A collector box according to claim 4, wherein said crimping teeth (10') that are supported on said shoulder (36) of said cover (6) and situated on both sides of said at least one recess (30) are located on a first side (38) of said collector plate (5), said collector plate (5) comprises crimping teeth (10) on sides (40, 42) adjacent to said first side (38) and said crimping teeth (10') located on both sides of said at least one recess (30) have a width greater than the width of said teeth (10) located on said adjacent sides (40, 42).

6. A collector box according to claim 1, wherein said back wall (44) has a thickness equal to a thickness of said box foot (20).

7. A collector box according to claim 2, wherein said collector plate (5) is crimped to said cover (6) on both sides of said at least one recess (30).

8. A collector box according to claim 6, wherein said at least one recess (30) is defined by a localised deformation of a profile of said arch (18) of said cover (6).

9. A heat exchanger for a motor vehicle, with said heat exchanger comprising a collector box, wherein the collector box comprises:

a collector plate (5), a cover (6) and a seal (7) which ensures sealing between said collector plate (5) and said cover (6), said seal (7) comprising an attachment portion (22) configured to be supported on at least one tube (2E) that circulates fluid of the heat exchanger, said attachment portion (22) having a grasping projection (24) for grasping said seal (7), said cover (6) having at least one recess (30) which receives said grasping projection (24), wherein said cover (6) comprises an arch (18) prolonged by a box foot (20), said box foot (20) serving to compress said seal (7), with a back wall (44) of said at least one recess (30) being situated perpendicular to said box foot (20) and wherein said at least one recess (30) is located on a portion (32) of the arch (18) and protrudes along the portion (32) in a direction away from said grasping projection (24) when assembled and wherein said at least one recess (30) creates a space between the at least one tube (2E) and the cover (6) in a region of said grasping projection (24).

* * * * *